US007299739B2

(12) United States Patent
Nakata et al.

(10) Patent No.: US 7,299,739 B2
(45) Date of Patent: Nov. 27, 2007

(54) HYDRAULIC CYLINDER

(75) Inventors: Akio Nakata, Tokyo (JP); Masakazu Tetsuka, Tokyo (JP)

(73) Assignee: Koganei Corporation, Tokyo (JP)

( * ) Notice: Subject to any disclaimer, the term of this patent is extended or adjusted under 35 U.S.C. 154(b) by 287 days.

(21) Appl. No.: 10/543,536

(22) PCT Filed: Jan. 29, 2004

(86) PCT No.: PCT/JP2004/000863

§ 371 (c)(1),
(2), (4) Date: Jul. 27, 2005

(87) PCT Pub. No.: WO2004/067971

PCT Pub. Date: Aug. 12, 2004

(65) Prior Publication Data

US 2006/0140781 A1 Jun. 29, 2006

(30) Foreign Application Priority Data

Jan. 29, 2003 (JP) ..... 2003-020201

(51) Int. Cl.
*F15B 15/26* (2006.01)

(52) U.S. Cl. ..... 92/15; 92/24; 92/29; 91/41; 91/43

(58) Field of Classification Search ..... 91/41, 91/43; 92/15, 24, 27, 28, 29, 85 A
See application file for complete search history.

(56) References Cited

U.S. PATENT DOCUMENTS 3,033,171 A * 5/1962 Engelbrecht et al. ..... 91/459
3,699,850 A * 10/1972 Wagner ..... 92/24
3,889,576 A 6/1975 Sheffer et al. ..... 91/394
4,524,676 A 6/1985 Rogers ..... 91/43
4,784,037 A * 11/1988 Fabyan et al. ..... 91/43
5,365,828 A * 11/1994 Sperber et al. ..... 91/41
5,522,303 A 6/1996 Stoll et al. ..... 92/27
6,598,513 B2 * 7/2003 Yabe ..... 91/404

FOREIGN PATENT DOCUMENTS

| | | |
|---|---|---|
| JP | 56-501854 | 12/1981 |
| JP | 04-283034 | 10/1992 |
| JP | 48-41191 | 12/1994 |
| JP | 7-506538 | 7/1995 |
| JP | 2001-32803 | 2/2001 |
| WO | WO 81/02044 | 7/1981 |
| WO | WO 94/20261 | 9/1994 |

* cited by examiner

*Primary Examiner*—Igor Kershteyn
(74) *Attorney, Agent, or Firm*—McCormick, Paulding & Huber LLP

(57) ABSTRACT

A fluid pressure cylinder has a piston rod 18 fixed to a piston 26 and projecting outside a cylinder body 23. A lock surface 43 inclining to a radial direction of the piston rod 18 is formed in an engagement member 31 provided in the piston rod 18. A lock rod 35 reciprocating in an about right-angle direction to the piston rod 18 is built into a lock cylinder 33 provided in the cylinder body 23. The lock rod 35 is provided with: a large-diameter section 35*a* fitted into a guide hole 36 formed in the lock cylinder 33; and a slide contact section 37 provided in the large-diameter section 35*a* via a constriction section 35*b*. The slide contact section 37 contacts with a radial-inner portion of the lock surface 43 when the lock rod 35 comes nearest to the piston rod 18.

6 Claims, 8 Drawing Sheets

HYDRAULIC CYLINDER

CROSS REFERENCE TO RELATED APPLICATIONS

This application claims the benefit of PCT Application No. PCT/JP2004/000863, filed on Jan. 29, 2004 and Japanese Patent Application No. 2003-020201, filed Jan. 29, 2003, the disclosures of which are herein incorporated by reference in its entirety.

TECHNICAL FIELD

The present invention relates to a fluid pressure cylinder axially reciprocating a rod by using fluid pressure such as compressed air and, particularly, to a fluid pressure cylinder axially applying a thrust force to a piston rod when supply of fluid pressure is cut off.

BACKGROUND OF THE INVENTION

For example, an automobile body is formed by assembling each of a plurality of panel members constituting the automobile body using a jointing means such as spot welding. In order to assemble the automobile body, the panel members become fixed to a conveyance truck by a clamping member and then a predetermined assembling operation such as spot welding is carried out at each work stage while the conveyance truck is moved in a body assembly line having work stages disposed per predetermined interval (e.g., see Japanese Patent Laid-open No. 4-283034. If a final stage and a first stage of the body assembly line are connected together by a returning line, the conveyance truck can be used in circulation.

The conveyance truck needs to be provided with the clamping member for fixing the panel members in their positioned states. When this clamping member is driven according to a movement of a piston rod of a pneumatic cylinder, a pipe that supplies air pressure to operate the pneumatic cylinder must be connected. However, during the movement of the conveyance truck, this pipe must be disconnected from the conveyance truck. Therefore, at the first stage and the last stage, the pipe is connected to the conveyance truck to supply the compressed air to the pneumatic cylinder, whereby an opening/closing operation of the clamping member is performed. However, while the conveyance truck moves in intermediate stages therebetween, the pipe is disconnected from the conveyance truck and, also during this movement, the panel members need to be continuously clamped.

Therefore, there is an air pressure cylinder provided with a braking mechanism so as to be able to control the piston rod even when the supply of air pressure is suspended. One example of this braking mechanism includes a locking mechanism, in which an engagement groove is formed in a side surface of a piston and, when the piston rod moves forward or backward to a predetermined position, a locking member is inserted into the engagement groove from a side direction of the cylinder using a spring force of a spring member in a direction orthogonal to a moving direction thereof, thereby locking a return movement of the piston rod.

Such a locking mechanism includes a type in which a slope surface such as a tapered surface is formed at a tip of the locking member in order to apply a thrust force to the piston rod and a spring force is applied to the locking member to apply the thrust force to the piston rod through the locking member. However, in order to downsize the fluid pressure cylinder having this locking mechanism, an important problem to be solved is that the spring member for applying the predetermined thrust force to the piston rod is downsized. Also in case of driving the locking member using fluid pressure such as compressed air, the fluid pressure cylinder can be downsized if the locking member can be driven by a piston with a small diameter.

SUMMARY OF THE INVENTION

An object of the present invention is to provide a fluid pressure cylinder that can securely apply a thrust force to a piston rod also by applying a small force to a lock rod that applies an axial thrust force to the piston rod when a supply of the fluid pressure is stopped.

A fluid pressure cylinder according to the present invention comprises: a cylinder body having a cylinder chamber in which a piston is reciprocably built, and which is partitioned by the piston into a forward fluid chamber and a backward fluid chamber; a piston rod secured to the piston and projecting from an end of the cylinder body to an outside of the cylinder body; an engagement member provided on the piston rod and having a lock surface formed to incline to a radial direction of the piston rod; a lock piston reciprocably built in a lock cylinder provided in the cylinder body in an approximately right-angle direction relative to the piston rod; and a lock rod provided in the lock piston and having a large-diameter section, which is engaged with a guide hole formed on the lock cylinder, and a slide contact section that is provided in the large-diameter section via a small-diameter constriction section and contacts with a radial-inner portion of the lock surface when the lock piston comes nearest to the piston rod.

In the fluid pressure cylinder according to the present invention, when the lock rod comes nearest to the piston rod, the slide contact section contacts inside a radial-center portion of the lock surface. Also, in the fluid pressure cylinder according to the present invention, an angle of the lock surface with respect to the piston rod is equal to or smaller than 45 degrees. Further, in the fluid pressure cylinder according to the present invention, a spring member applying a spring force to the lock rod toward the piston rod is provided in the lock cylinder, and a lock release fluid chamber applying a thrust force in a direction away from the piston rod is formed in the lock cylinder.

The fluid pressure cylinder according to the present invention, a slope guide surface is formed on the engagement member, the slope guide surface inclining to a direction opposite to the lock surface at an angle larger than that of the lock surface and moving the lock rod backward against the spring force when the piston rod is moved. Also, in the fluid pressure cylinder according to the present invention, an angle of the slope guide surface with respect to the piston rod is 45 degrees or more.

According to the present invention, since the slide contact section contacting with the radial-inner portion of the lock surface of the engagement member is provided in the lock rod contacting with the engagement member provided on the piston rod, a position of the force point for transmitting the maximum thrust force between the lock rod and the engagement member can be set on a radial-inner side of the engagement member, whereby the axial thrust force of the lock rod can be increased toward the piston rod to be transmitted to the axial thrust force of the piston rod. By doing so, since the outer diameter of the lock piston provided in the lock rod can be made smaller, the fluid pressure cylinder can be downsized.

Since the lock rod has the large-diameter section and the large-diameter section is slidably fitted into the guide hole formed in the lock cylinder, the lock rod can be axially slid smoothly even when a bending force is applied to the lock rod.

By applying the spring force to the lock rod, the thrust force can be securely applied to the piston rod even if a fluid-pressure supply circuit is in trouble. Further, since the slope guide surface is formed on the engagement member, the lock rod is moved backward by moving the piston rod, whereby the lock rod can be securely brought into contact with the lock surface.

DESCRIPTION OF PREFERRED EMBODIMENTS

Figure 1:
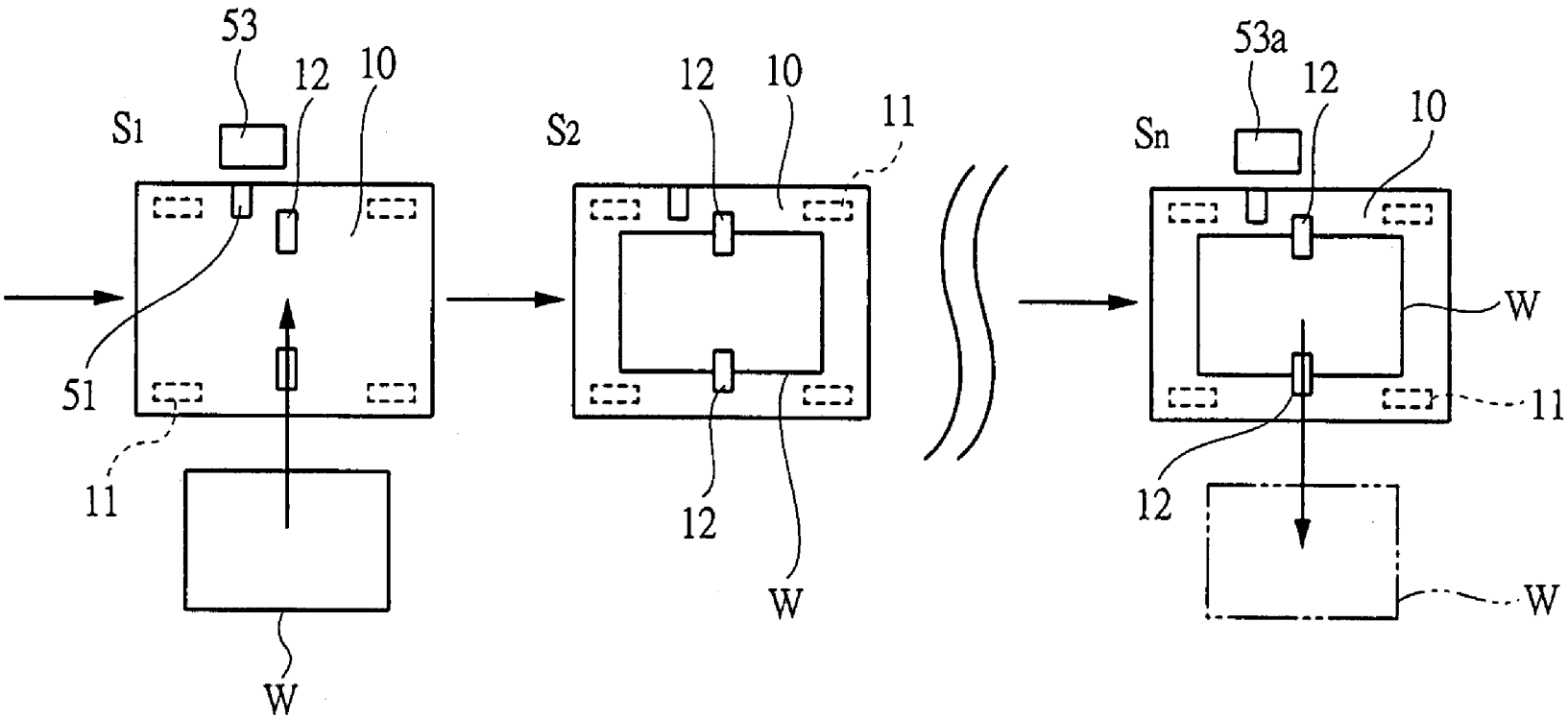
FIG. 1 is a top view showing a part of an automobile-body assembly line in which a conveyance truck conveys panel members constituting an automobile body.

Embodiments of the present invention will be detailed below with reference to the drawings. In an automobile-body assembly line as shown in FIG. 1, panel members are conveyed by a conveyance truck, and a conveyance truck 10 has a plurality of wheels 11, thereby running from a first stage S1 to a last stage Sn. At the first stage S1, the panel members constituting an automobile body are conveyed as workpieces W to the conveyance truck 10. The workpiece W is processed at each stage such as a stage S2 during the running. At the last stage Sn, the workpiece W for which a predetermined assembly operation is finished is taken out from the conveyance truck 10. Each conveyance truck 10 is provided with clamping devices 12 that clamp, i.e., hold the workpieces W. In FIG. 1, each conveyance truck 10 is provided with two clamping devices 12. However, depending on size etc. of the workpiece W, the number of clamping devices 12 can be arbitrarily provided in the conveyance truck 10.

Figure 2:
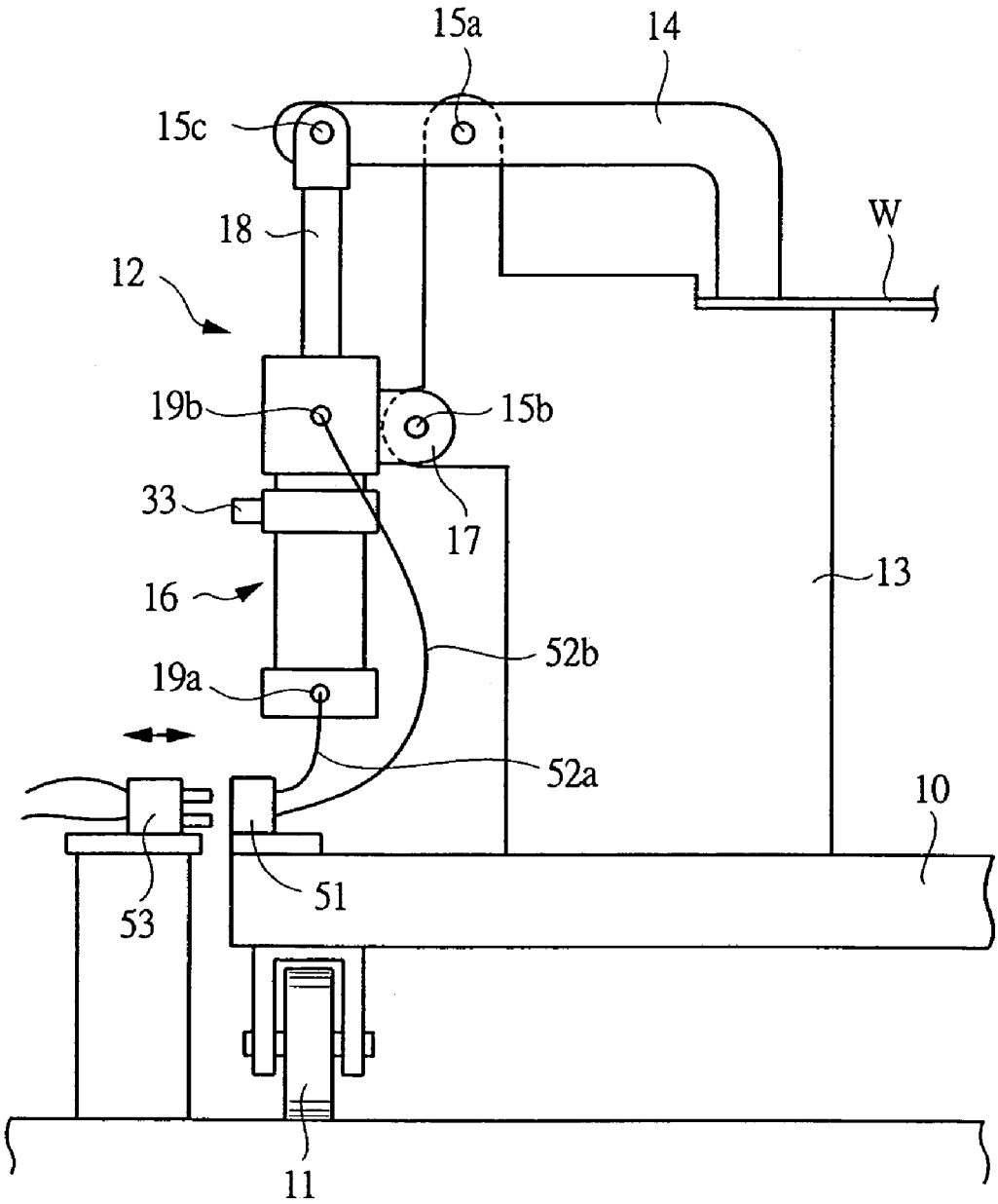
FIG. 2 is an enlarged front view showing a clamping device that is provided in the conveyance truck in FIG. 1.

FIG. 2 is an enlarged front view of the clamping device 12. The conveyance truck 10 is provided with a workpiece supporting table 13 for supporting the workpiece W. A clamping arm 14 for clamping the workpiece W along with the supporting table 13 is mounted on the supporting table 13 so as to be swingable around a pin 15*a*. A fluid pressure cylinder 16 is mounted on the supporting table 13 so as to be swingable around a pin 15*b* at a portion of a crevice 17 fixed thereto. A piston rod 18 of the fluid pressure cylinder 16 is connected to the clamping arm 14 by a pin 15*c*. The clamping arm 14 clamps the workpiece W when the piston rod 18 moves forward, i.e., in a direction of protruding from an interior of the fluid pressure cylinder 16 and reaches a position of a predetermined stroke end.

Figure 3:
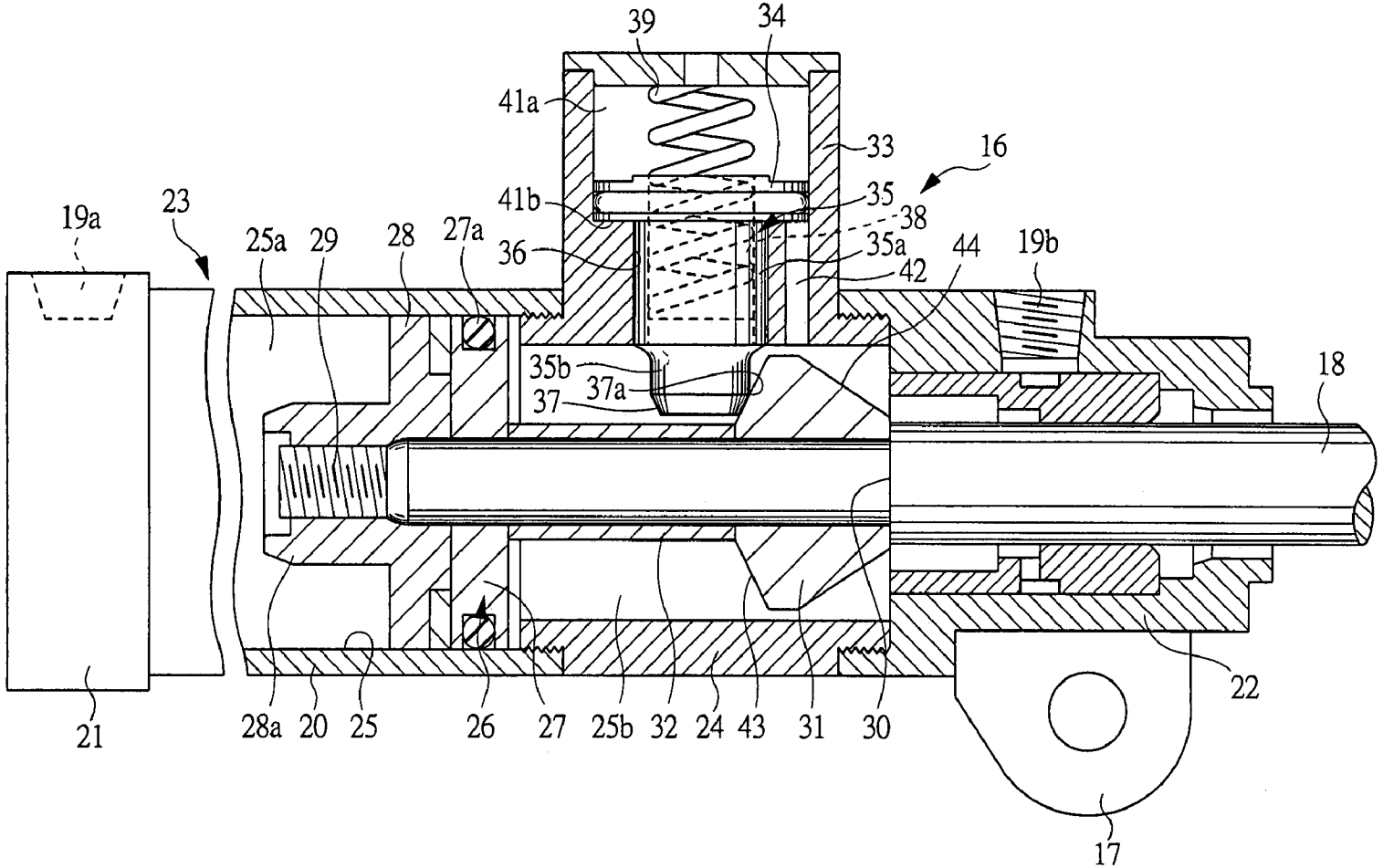
FIG. 3 is an enlarged cross-sectional view showing a fluid pressure cylinder that is applied to the clamping device in FIG. 2 according to an embodiment of the present invention.
Figure 4:
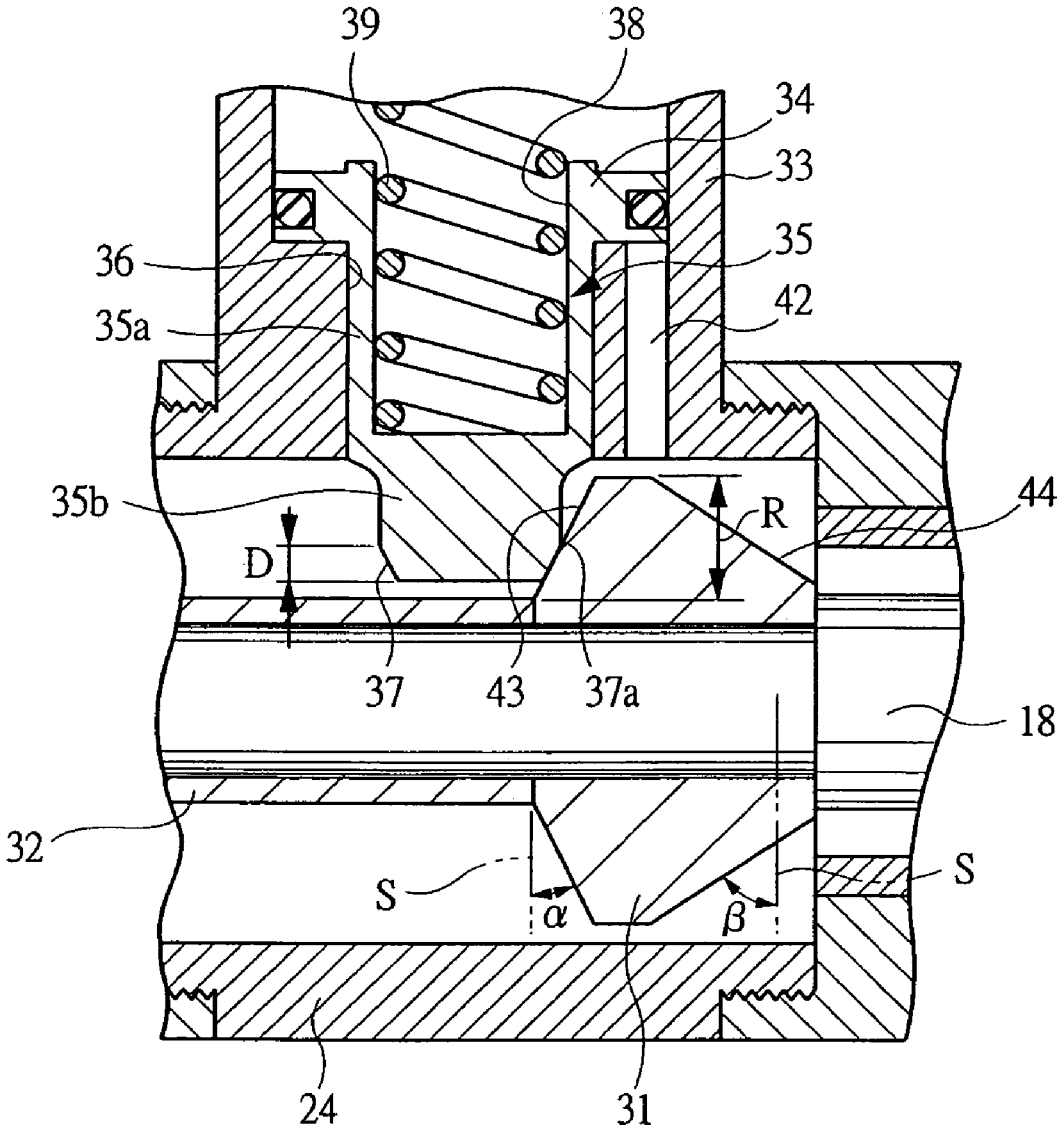
FIG. 4 is an enlarged cross-sectional view showing a part of FIG. 3.

FIG. 3 is an enlarged cross-sectional view showing the fluid pressure cylinder 16 in FIG. 2. FIG. 4 is an enlarged cross-sectional view showing a part of the fluid pressure cylinder 16 in FIG. 3. This fluid pressure cylinder 16 has a cylinder body 23 comprising: a cylinder tube 20; an end cover 21 fixed to one end thereof; and a rod cover 22 fixed to the other end thereof. Supply/exhaust ports 19*a* and 19*b* are provided on the end cover 21 and the rod cover 22, respectively. The rod cover 22 is fixed to the other end of the cylinder tube 20 via a lock tube 24. The lock tube 24 constitutes the cylinder body 23, and a cylinder chamber 25 is formed in the cylinder body 23.

A piston 26 is mounted in the cylinder chamber 25 so as to be reciprocable axially. The piston rod 18, mounted on the cylinder body 23 so as to be reciprocable axially, is fixed to the piston 26. An interior of the cylinder chamber 25 is partitioned into a forward fluid chamber 25*a* and a backward fluid chamber 25*b* by this piston 26. Therefore, when compressed air is supplied from the supply/exhaust port 19*a* to the forward fluid chamber 25*a*, the piston rod 18 moves forward in a protruding direction. When the compressed air is supplied from the supply/exhaust port 19*b* to the backward fluid chamber 25*b*, the piston rod 18 moves backward in a direction of being inserted into the cylinder tube 20.

The piston 26 has a first disk 27 provided with a sealing member 27*a* on its outer periphery, and a second disk 28 having a screw 28*a*. Since a female screw formed on the screw 28*a* is screw-connected to a male screw 29 formed at an end of the piston rod 18, the piston 26 is fixed to the piston rod 18. An engagement member 31 and a sleeve 32 are fixed between the piston 26 and a step portion 30 of the piston rod 18. A lock cylinder 33 is integrally formed with the lock tube 24 to apply a thrust force to the piston rod 18 in engagement with the engagement member 31. This lock cylinder 33 is in a direction perpendicular to the cylinder body 23. Note that although the engagement member 31 is engaged with the piston rod 18 in FIG., the engagement member 31 may be integrated into the piston rod 18.

A lock piston 34 is mounted within the lock cylinder 33 so as to be reciprocable in a direction perpendicular to the piston rod 18. A lock rod 35 is provided integrally with the lock piston 34. The lock rod 35 has a large-diameter section 35*a* slidably fitted into a guide hole 36 formed in the lock cylinder 33, and a constriction section 35*b* with a smaller diameter than that of the large-diameter section 35*a*. A tip of the constriction section 35*b* is provided with a tapered slide contact section 37 whose diameter becomes smaller toward its tip surface.

A spring accommodation hole 38 is formed at each center of the lock piston 34 and the lock rod 35 integrated therewith. A helical compression spring 39 as a spring member for applying a spring force to the lock rod 35 toward the piston rod 18 is incorporated in the spring accommodation hole 38. An interior of the lock cylinder 33 is partitioned into a spring accommodation chamber 41*a* and a lock release fluid chamber 41*b* by the lock piston 34. The lock release fluid chamber 41*b* communicates with the supply/exhaust port 19*b* via a communication hole 42 formed in the lock cylinder 33. Therefore, by fluid supplied to the lock release fluid chamber 41*b*, a thrust force against the spring force is applied to the lock rod 35 in a direction away from the piston rod 18.

A lock surface 43, with which the slide contact section 37 at the tip of the lock rod 35 contacts when the piston rod 18 approaches a forward limit stroke end, is formed on the engagement member 31. As shown in FIG. 4, the lock surface 43 is inclined by an angle of $\alpha$ toward the tip of the piston rod 18 with respect to a radial surface S of the piston rod 18. When being shown in FIG. 3, the inclination angle $\alpha$ is about 30 degrees and corresponds to an inclination angle of the slide contact section 37 of the lock rod 35. The slide contact section 37 and the lock surface 43 both are circular conical surfaces, so that when the slide contact section 37 contacts with the lock surface 43, these sections line-contact with each other. However, since the lock rod 35 and the engagement member 31 are deformed elastically, the line contact is made with a predetermined width. When the lock rod 35 contacts with the lock surface 43, a spring force of the spring member 39 increases due to a wedge effect and is transmitted to the piston rod 18, whereby the spring force exerted in a direction of clamping, i.e., locking the clamp arm 14, namely, the thrust force is applied to the piston rod 18. If the inclination angle $\alpha$ is equal to or smaller than 45 degrees required for increasing the spring force, it is not limited to 30 degrees.

Meanwhile, a slope guide surface 44, having an inclination angle of $\beta$ toward a rear end of the piston rod 18 with respect to the radial surface S, is formed on a tip side of the engagement member 31. This angle $\beta$ is 60 degrees that is larger than 45 degrees if being illustrated in FIG. 3. Therefore, by the fluid supplied to the forward fluid chamber 25*a*, the piston rod 18 protrudes and moves from a backward limit position to a forward limit position, and the tip of the lock rod 35 contacts with the slope guide surface 44. At this time, since the spring force of the spring member 39 is not converted into a large thrust force in a direction of returning the piston rod 18, the lock rod 35 moves backward in a direction away from the piston rod 18 by the compressed air against the spring force.

As described above, in this fluid pressure cylinder, the lock rod 35 reciprocating in a radial direction of the piston rod 18 is pressed against the lock surface 43 of the engagement member 31, and the spring force in a linear direction of the lock rod 35 is converted into the axial thrust force of the piston rod 18 via the engagement member 31. Therefore, during a pressing time, a bending moment is applied to the lock rod 35 from the engagement member 31. However, since the lock rod 35 is fitted into the guide hole 36 due to the large-diameter section 35*a*, it reciprocates smoothly without inclining. In order to drive the clamp arm 14 by the piston rod 18 and clamp the workpiece, the slide contact section 37 at the tip of the lock rod 35 needs to press the lock surface 43 to such an extent that elastic distortion occurs therein due to elastic deformation of the clamp arm 14 and the piston rod 18. In the slide movement at the pressing time, since the constriction section 35*b* is formed on the lock rod 35, only the slide contact section 37 at the tip of the lock rod 35 intensively contacts with the lock surface 43. At a lock completing time when the lock rod 35 comes nearest to the piston rod 18, a radial-outer portion of the lock surface 43 does not contact with the contact section 37. Namely, the slide contact section 37 contacts only with the radial-inner portion of the lock surface 43.

When the lock rod 35 is made to contact with the lock surface 43, as described above, the bending moment is applied to the lock rod 35. Therefore, since the tip, which is not fitted into the guide hole 36, is elastically deformed and bent, the maximum axial force is applied to a root portion of the slide contact section 37, i.e., to a boundary portion 37*a* between the tapered slide contact section and a straight portion. Consequently, at the lock completing time, if the lock rod 35 is made to line-contact with the radial-outer portion of the lock surface 43, the spring force transmitted from the lock rod 35 to the engagement member 31 is mainly exerted on the radial-outer portion of the lock surface 43. In contrast, in the fluid pressure cylinder shown in FIG., by forming the constriction section 35*b* on the lock rod 35, while the large-diameter section 35*a* of the lock rod 35 is maintained to have a desired outer diameter, the slide contact section 37 can contact only with the radial-inner portion of the lock surface 43 and a position to which the maximum axial force is applied can be set to the radial-inner portion of the lock surface 43. As shown in FIG. 4, when a width of the slide contact section 37 is D and a radial dimension of the lock surface 43 is R, the width D is set to be approximately one half of or smaller than the radial dimension R. Therefore, when the lock rod 35 reaches the forward limit position toward the piston rod 18, namely, at the lock completing time, the slide contact section 37 can contact inside a radial-center portion of the lock surface 43.

Thus, since the position to which the maximum axial force is applied can be set to be inside the lock surface, the spring force of the spring member 39 can be increased and transmitted from the lock rod 35 to the piston rod 18. Accordingly, since the small spring member 39 can be used, the lock cylinder 33 can be downsized. Note that when being illustrated, the thrust force is applied to the piston rod 18 from the lock rod 35 by the spring member 39, but the thrust force may be applied to the piston rod 18 by the compressed air by using the spring accommodation chamber 41*a* as a fluid chamber and using a double-acting cylinder for the lock cylinder 33 instead of using the spring member 39.

Figure 5A:
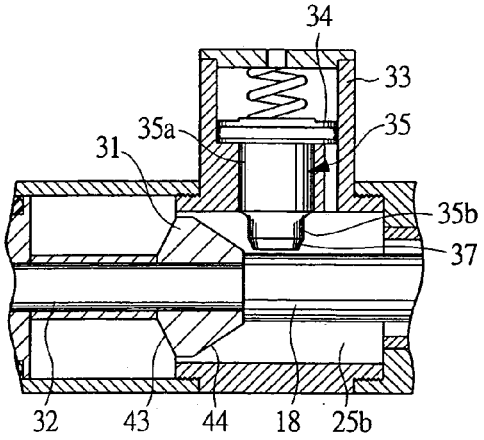
FIG. 5A is a cross-sectional view showing an operation state of a lock piston that follows a movement of a piston rod.
Figure 5C:
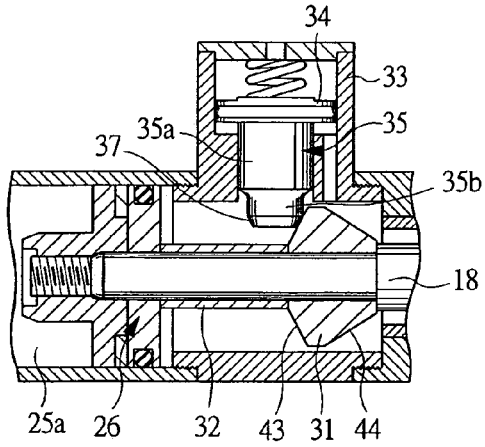
FIG. 5C is a cross-sectional view showing an operation state of a lock piston that follows a movement of a piston rod.
Figure 5B:
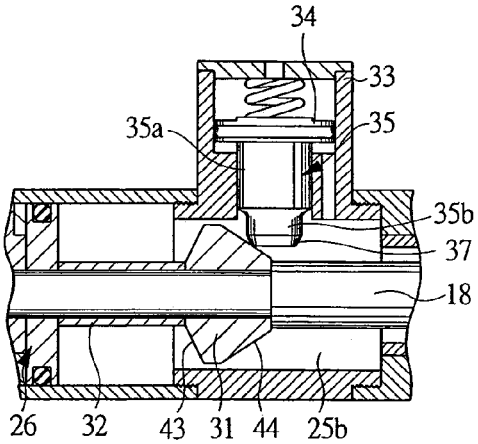
FIG. 5B is a cross-sectional view showing an operation state of a lock piston that follows a movement of a piston rod.

FIGS. 5A to 5D are schematic views showing operation states of the lock rod 35 when the piston rod 18 is moved to the stroke end of the forward limit by supplying the compressed air to the forward fluid chamber 25*a*. FIG. 5A illustrates a state in which the piston rod 18 projects and moves until immediately before the tip of the lock rod 35 contacts with the slope guide surface 44. In this state, when the piston rod 18 moves toward the stroke end of the forward limit, as shown in FIG. 5B, the slide contact section 37 contacts with the slope guide surface 44 and consequently the lock rod 35 moves backward against the spring force of the spring member 39. When the piston rod 18 further moves forward, as shown in FIG. 5C, the slide contact section 37 contacts with the lock surface 43. Consequently, the thrust force is applied to the piston rod 18 in a projecting direction thereof by the spring force.

Figure 5D:
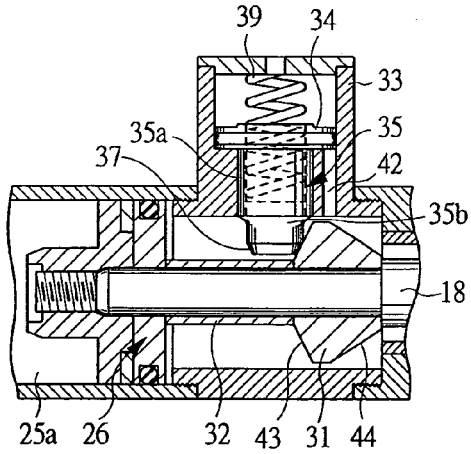
FIG. 5D is a cross-sectional view showing an operation state of a lock piston that follows a movement of a piston rod.

FIG. 5D illustrates a state in which the piston rod 18 further moves forward and the clamp arm 14 connected to the piston rod 18 is at the clamp completing position. In this state, even when the compressed air is discharged to the outside from the forward fluid chamber 25*a*, the lock rod 35 is engaged with the engagement member 31. Therefore, a forward elastic force is applied to the piston rod 18 by the spring force of the spring member 39, and the clamp arm 14 can continue clamping the workpiece W with a predetermined thrust force. When the workpiece W is clamped, a gap is present between a tip surface of the lock rod 35 and the sleeve 32, as shown in FIG. 5D, thereby being able to absorb an error of thickness of the workpiece W.

In order to move the piston rod 18 backward from the clamp completing position shown in FIG. 5D, the compressed air is supplied from the supply/exhaust port 19*b* to the backward fluid chamber 25*b*. By doing so, the compressed air flows into the lock release fluid chamber 41*b* via the communication hole 42 and the lock rod 35 moves backward against the spring force of the spring member 39, whereby the engagement of the lock rod 35 and the engagement member 31 is released. Then, the piston rod 18 moves backward by the compressed air in the backward fluid chamber 25*b*.

In order to supply the compressed air to the fluid pressure cylinder 16, a supply/exhaust hose 52*a* connected to the supply/exhaust port 19*a* and a supply/exhaust hose 52*b* connected to the supply/exhaust port 19*b* are connected in a supply/exhaust joint 51 provided in the conveyance truck 10, as shown in FIG. 2. Supplying of the compressed air from the outside and exhausting of it from the inside with respect to the forward fluid chamber 25*a* and the backward fluid chamber 25*b* are executed via the supply/exhaust joint 51.

Meanwhile, a supply/exhaust joint 53 is provided adjacent to the conveyance truck 10 at the first stage S1 shown in FIG. 1. A supply/exhaust hose connected to this supply/exhaust joint 53 is connected to an air pressure source unshown via a channel switch valve. When the conveyance truck 10 reaches a position in the first stage S1, the supply/exhaust joints 51 and 53 are connected to each other and can make a switch of supply of the compressed air from the air pressure source provided outside the conveyance truck 10 to each of the fluid chambers 25*a* and 25*b* and of exhaust of the compressed air to the outside. For this reason, after the workpiece W is conveyed onto the workpiece supporting table 13 in a state where the clamp arm 14 is opened, since the clamp arm 14 is closed by the fluid pressure cylinder 16, the workpiece W can be clamped.

Thus, by moving the conveyance truck 10 in a state where the workpiece W is clamped, a predetermined assembly operation can be carried out using the conveyance truck 10 at each stage that constitutes the automobile-body assembly line. At the last stage Sn shown in FIG. 1, the supply/exhaust joint 53*a* connected to the truck-side supply/exhaust joint 51 is provided to supply the compressed air to the backward fluid chamber 25*b*. Therefore, by opening the clamp arm 14 at the stage Sn, the workpiece W after completing the predetermined assembly operation can be carried out outside the line.

Next, a workpiece clamping process of the clamping device 12 that uses the above-mentioned fluid pressure cylinder 16 will be described. In order to open the clamp arm 14 by moving the piston rod 18 backward, the compressed air is supplied to the backward fluid chamber 25*b* via the supply/exhaust joints 51 and 53. In this state, the piston rod 18 is at a backward limit position and becomes in a most retreated state within the cylinder body 23 and the clamp 14 is opened, whereby the workpiece W can be carried in. To close the clamp arm 14, the compressed air is supplied to the forward fluid chamber 25*a*. Consequently, the piston rod 18 moves forward and the clamp arm 14 is closed, so that when the piston rod then moves forward, the clamp force is applied to the piston rod 18 by the lock rod 35 and the elastic distortion occurs in the piston rod 18 in a compression direction, as shown in FIGS. 5B to 5D. Therefore, even when vibration or impact is applied to the conveyance truck 10 while conveying the conveyance truck 10, the workpiece W can be securely held without loosening the clamping force of the clamp arm 14 to the workpiece W.

Figure 6:
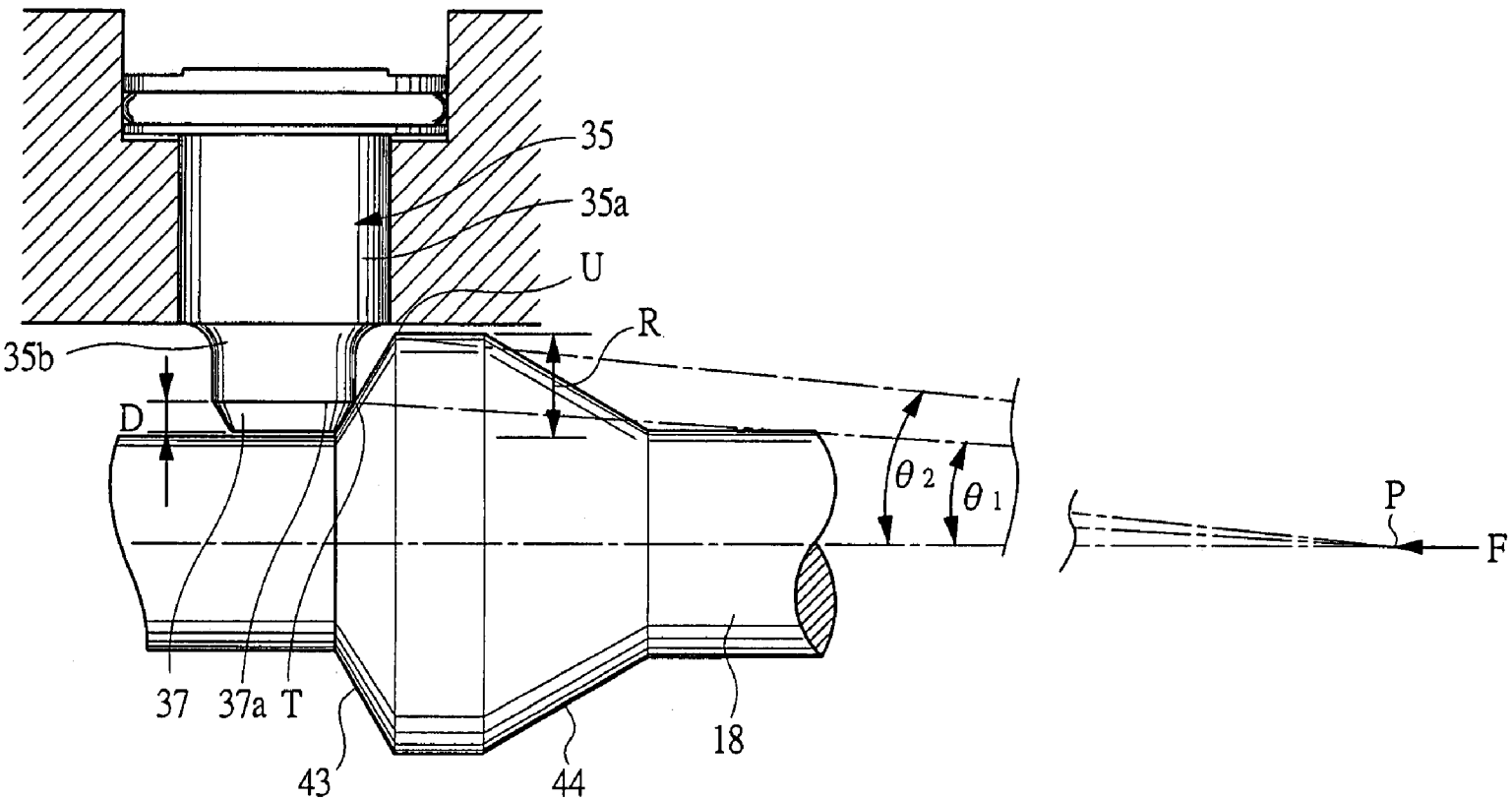
FIG. 6 is a schematic view showing a transmission state of a clamping force in the fluid pressure cylinder according to the present invention.
Figure 7:
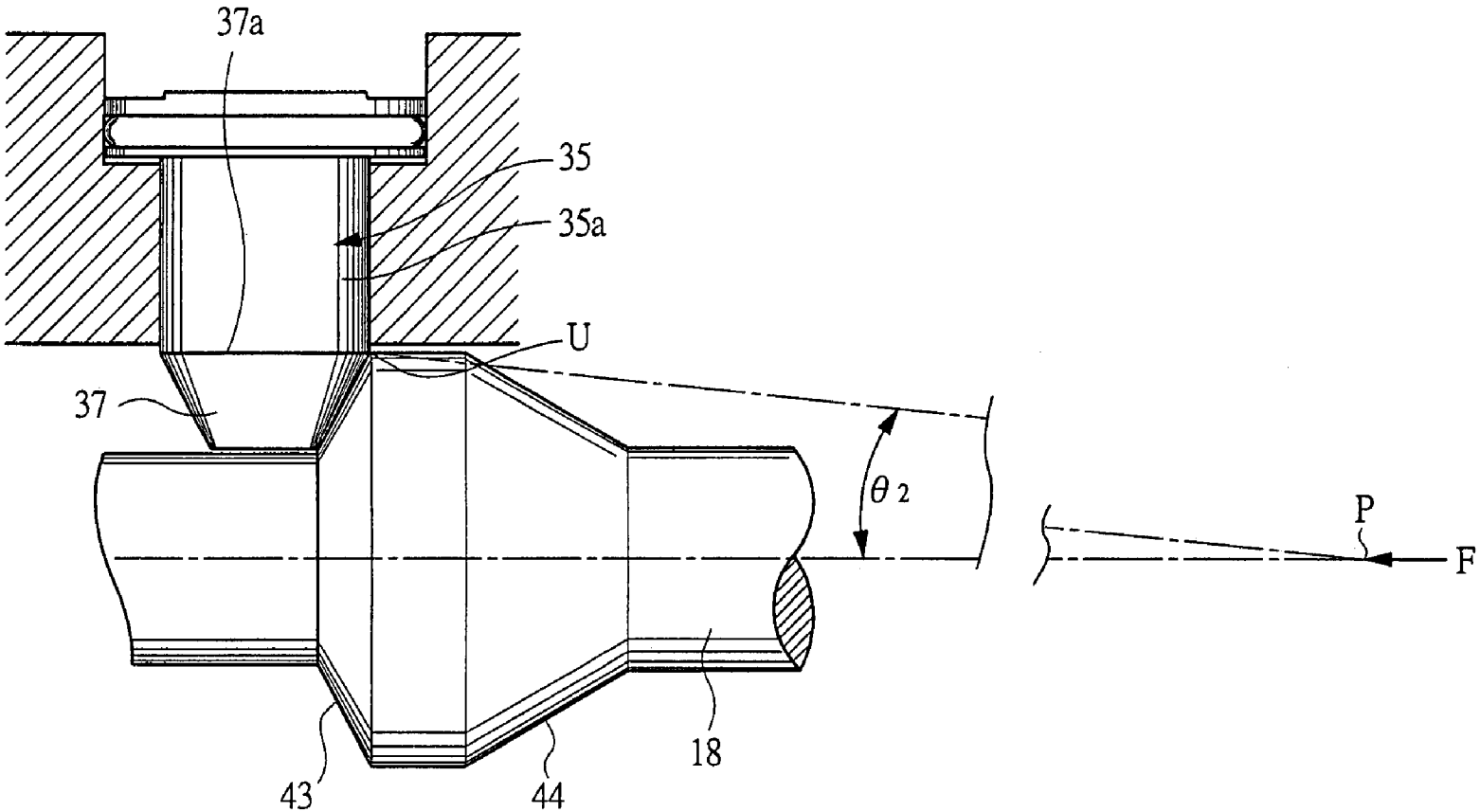
FIG. 7 is a schematic view showing a transmission state of a clamping force in the fluid pressure cylinder as a comparative example.

FIG. 6 is a schematic view showing a transmission state of a clamping force in the fluid pressure cylinder according to the present invention. FIG. 7 is a schematic view of a transmission state showing a clamping force in the fluid pressure cylinder having a lock rod in which no constriction section is provided, as a comparative example.

In the present invention, since the slide contact section 37 is formed at the tip of the lock rod 35 by forming the constriction section 35*b* and the slide contact section 37 is made to contact with a part of the lock surface 43, the slide contact section contacts only with the radial-inner portion of the lock surface 43 at the lock completing time. Since the tip of the lock rod 35 is subjected to a bending force by the axial force applied from the engagement member 31, the root portion 37*a* of the slide contact section 37 applies the thrust force to the lock surface 43, thereby becoming a force point T. Therefore, the maximum spring force is transmitted from the lock rod 35 to the engagement member 31. Meanwhile, as shown in FIG. 7, if the slide contact section 37 is made to line-contact radially with the whole of the lock surface 43 without forming the constriction section 35*b*, a force point where the root portion 37*a* of the slide contact section 37 applies the thrust force to the lock surface 43 becomes a point U, whereby the maximum spring force is applied from the point U to the piston rod 18.

Figure 8:
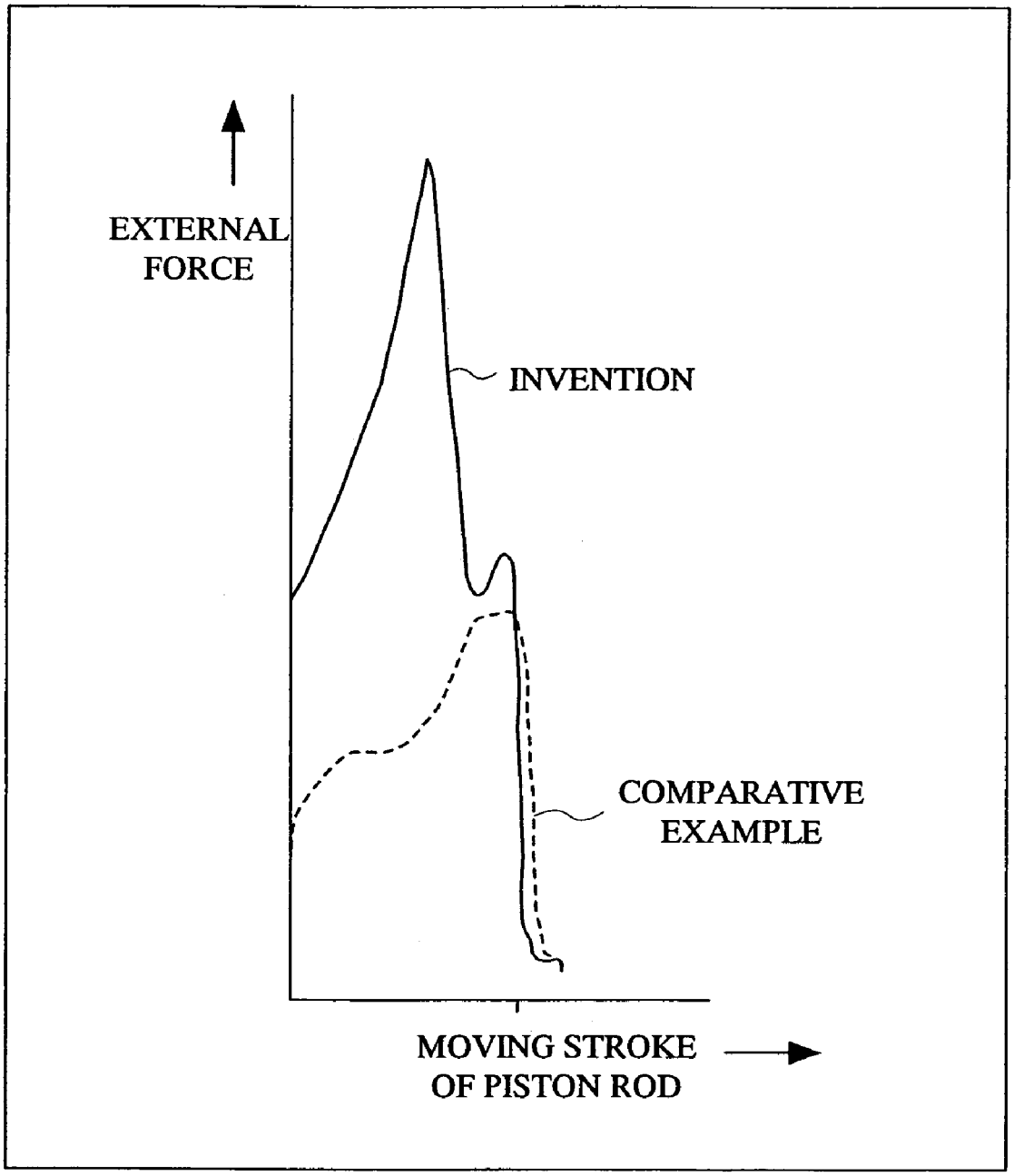
FIG. 8 is a characteristic line diagram showing a difference of external forces due to a difference of contact point positions when an axial external force is applied to the piston rod to return and move the lock rod in a state where the lock rod contacts with a lock surface.

FIG. 8 is a characteristic line diagram showing a result of measuring a moving stroke of the piston rod 18 while, as shown by the reference symbol "P" in FIGS. 6 and 7 different in a state of using the fluid pressure cylinder, an external force F is gradually increasingly applied to the working point P of the piston rod 18. In FIG. 8, a solid line is a characteristic line according to the present invention in which, as shown in FIG. 6, the force point is "T" by forming the constriction section 35*b* in the lock rod 35, and a broken line is a characteristic line of the comparative example in which, as shown in FIG. 7, the force point is "U" without forming a constriction section in the lock rod 35. It turns out that: if an angle θ1 formed as shown in FIG. 6 between a line connecting the force point T and the working point P and a center line of the piston rod 18 is compared to an angle θ2 formed as shown in FIG. 7 between a line connecting the force point U and the working point P and the center line of the piston rod 18, the angle θ1 is smaller than the angle θ2; and when the case where the constriction section 35*b* is formed to set the force point T as sown in FIG. 6 on a radial-inner side of the lock surface 43 is compared to the case where the force point U as shown in FIG. 7 is formed on an outer periphery of the lock surface 43, the lock rod 35 does not return unless an large external force is applied to the working point P. This means that even if the same spring force is applied to the lock rod 35, a larger thrust force can be applied to the piston rod 18 by setting the force point T on a radial-inner side of the lock surface 43.

The present invention is not limited to each of the above-mentioned embodiments and may be variously modified and altered without departing from the gist thereof. For example, the fluid pressure cylinder 16 moves forward, i.e., presses and moves the piston rod 18 to clamp the workpiece by the clamp arm 14. However, it may move backward, i.e., pull and move the piston rod 18 to clamp the workpiece by the clamp arm 14. In this case, a tensile stress occurs in the piston rod 18 in a clamping state. The fluid pressure cylinder 16 can be also applied to a fluid pressure cylinder for driving a clamp arm built into a slit formed in a locating pin, as described in the above Patent Gazette. Further, although the fluid pressure cylinder 16 is used to drive the clamping device 12 provided in the conveyance truck 10, it may be also applied to clamp and convey the panel members fixed to a tip of a robot arm.

The use of the fluid pressure cylinder is not limited to the clamping of the panel members, and the fluid pressure cylinder 16 can be also applied to any purpose if the thrust force occurs in the piston rod by stopping the piston rod at a predetermined position. Although the fluid pressure cylinder 16 moves the piston 18 by using the compressed air, the piston 18 can be also reciprocated by a fluid pressure such as a hydraulic pressure.

INDUSTRIAL APPLICABILITY

When an automobile body is assembled while panel members constituting the automobile body are conveyed by a conveyance truck, this fluid pressure cylinder is provided in the conveyance truck and used to clamp the panel members.

The invention cliamed is:

1. A fluid pressure cylinder comprising:

a cylinder body having a cylinder chamber in which a piston is reciprocably built, and which is partitioned by the piston into a forward fluid chamber and a backward fluid chamber;

a piston rod secured to the piston and projecting from an end of the cylinder body to an outside of the cylinder body;

an engagement member provided on the piston rod and having a lock surface formed to incline to a radial direction of the piston rod;

a lock piston reciprocably built in a lock cylinder provided in the cylinder body in an approximately right-angle direction to the piston rod; and a lock rod provided in the lock piston and having a large-diameter section, which is engaged with a guide hole formed on the lock cylinder, and a slide contact section that is provided in the large-diameter section by forming a small-diameter constriction section and contacts with a radial-inner portion of the lock surface when the lock piston comes nearest to the piston rod.

2. The fluid pressure cylinder according to claim 1, wherein when the lock rod comes nearest to the piston rod, the slide contact section contacts inside a radial-center portion of the lock surface.

3. The fluid pressure cylinder according to claim 1, wherein an angle of the lock surface with respect to a radial surface of the piston rod is equal to or smaller than 45 degrees.

4. The fluid pressure cylinder according to claim 1, wherein a spring member applying a spring force to the lock rod toward the piston rod is provided in the lock cylinder, and a lock release fluid chamber applying a thrust force in a direction away from the piston rod is formed in the lock cylinder.

5. The fluid pressure cylinder according to claim 4, wherein a slope guide surface is formed on the engagement member, the slope guide surface inclining to a direction opposite to the lock surface at an angle larger than that of the lock surface and moving the lock rod backward against the spring force when the piston rod is moved.

6. The fluid pressure cylinder according to claim 5, wherein an angle of the slope guide surface with respect to the piston rod is 45 degrees or more.

* * * * *